US009969162B2

(12) United States Patent
Saimen et al.

(10) Patent No.: US 9,969,162 B2
(45) Date of Patent: May 15, 2018

(54) MEMS DEVICE, LIQUID EJECTING HEAD, AND LIQUID EJECTING APPARATUS

(71) Applicant: SEIKO EPSON CORPORATION, Tokyo (JP)

(72) Inventors: Munehide Saimen, Suwa (JP); Eiju Hirai, Azumino (JP); Masao Nakayama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/493,011

(22) Filed: Apr. 20, 2017

(65) Prior Publication Data

US 2017/0313074 A1 Nov. 2, 2017

(30) Foreign Application Priority Data

Apr. 27, 2016 (JP) ..... 2016-088878

(51) Int. Cl.
*B41J 2/14* (2006.01)
*B41J 2/16* (2006.01)

(52) U.S. Cl.
CPC ..... *B41J 2/14233* (2013.01); *B41J 2/161* (2013.01); *B41J 2/1623* (2013.01); *B41J 2/1626* (2013.01); *B41J 2/1631* (2013.01); *B41J 2/1642* (2013.01); *B41J 2/1646* (2013.01); *B41J 2002/14491* (2013.01)

(58) Field of Classification Search
CPC ..... B41J 2/14233; B41J 2/1646; B41J 2/161; B41J 2/1631; B41J 2/1626; B41J 2/1623; B41J 2/1642; B41J 2002/14491; B41J 2/14072
See application file for complete search history.

(56) References Cited

U.S. PATENT DOCUMENTS

| | | | | |
|---|---|---|---|---|
| 2004/0113994 | A1 | 6/2004 | Shinkai | |
| 2007/0159511 | A1 | 7/2007 | Shinkai | |
| 2009/0237454 | A1* | 9/2009 | Kanemoto | B41J 2/14233 347/47 |
| 2016/0035966 | A1* | 2/2016 | Hamaguchi | H01L 41/0475 29/25.35 |
| 2016/0059559 | A1* | 3/2016 | Nakamura | B41J 2/14233 347/70 |

FOREIGN PATENT DOCUMENTS

| | | |
|---|---|---|
| JP | 2004-136663 | 5/2004 |
| JP | 2007-268838 | 10/2007 |
| JP | 2014-079931 | 5/2014 |

* cited by examiner

*Primary Examiner* — Geoffrey Mruk
(74) *Attorney, Agent, or Firm* — Workman Nydegger

(57) ABSTRACT

A MEMS device includes a first substrate in which a first electrode layer, a dielectric layer, and a second electrode layer are stacked on a driving region in this order; and a second substrate which is disposed to face a surface on which the dielectric layer of the first substrate is stacked. The first electrode layer and the dielectric layer extend beyond the second electrode layer toward a non-driving region separated from the driving region, a first resin having elasticity is disposed in a region including an end of the second electrode layer in an extending direction of the dielectric layer, and the first substrate and the second substrate are fixed with an adhesive in a state where the elastically deformed first resin is sandwiched therebetween.

12 Claims, 8 Drawing Sheets

MEMS DEVICE, LIQUID EJECTING HEAD, AND LIQUID EJECTING APPARATUS

The entire disclosure of Japanese Patent Application No: 2016-088878, filed Apr. 27, 2016 is expressly incorporated by reference herein in its entirety.

BACKGROUND

1. Technical Field

The present invention relates to a MEMS device which is used for ejection or the like of a liquid, a liquid ejecting head, and a liquid ejecting apparatus, and more particularly to a MEMS device in which a first electrode layer, a dielectric layer, and a second electrode layer are sequentially stacked on a driving region, a liquid ejecting head, and a liquid ejecting apparatus.

2. Related Art

A micro electro mechanical systems (MEMS) device is applied to various devices. For example, a liquid ejecting head, which is a type of MEMS device, is applied to a liquid ejecting apparatus used for various types of manufacturing as opposed to a liquid ejecting apparatus used for image recording an ink jet-type printer, an ink jet-type plotter, or the like. Specifically, the liquid ejecting head is applied to a display manufacturing apparatus for manufacturing a color filter of a liquid crystal display or the like, an electrode forming apparatus for forming an electrode of an organic electro luminescence (EL) display, a face emitting display (FED), or the like, and a chip manufacturing apparatus for manufacturing a biochip (biochemical element) or the like. Liquid ink is ejected from a recording head of the image recording apparatus, and a solution of each color material of red (R), green (G), and blue (B) is ejected from a color material ejecting head of the display manufacturing apparatus. In addition, a liquid electrode material is ejected from the electrode material ejecting head of the electrode forming apparatus, and a solution of a bioorganic material is ejected from a bioorganic ejecting head of the chip manufacturing apparatus.

The liquid ejecting head described above includes a pressure chamber which communicates with a nozzle, a piezoelectric element in which a first electrode layer, a piezoelectric layer, which is a type of dielectric layer, and a second electrode layer are stacked in this order on a surface dividing the pressure chamber, and a sealing plate, which is a kind of protective member for protecting the piezoelectric element. The liquid ejecting head causes pressure fluctuation in the liquid in the pressure chamber by causing deformation of the piezoelectric layer through application of a voltage (electric signal) to both electrode layers, and ejects liquid from the nozzle. In addition, as the liquid ejecting head, the piezoelectric layer and the first electrode layer are extended beyond the second electrode layer, and the sealing plate is adhered and fixed to an end portion of the second electrode layer (see JP-A-2014-79931).

As in a configuration in JP-A-2014-79931 described above, when the sealing plate is adhered to a substrate on which the piezoelectric element is formed, there is a concern that stress may be generated in accordance with curing shrinkage of an adhesive, the adhesive may peel off at an interface between the second electrode layer and the adhesive, and an end portion of the second electrode layer may peel off from the piezoelectric layer. On the other hand, the stress is concentrated at an end of the second electrode layer when the piezoelectric element is deformed since the end of the second electrode layer is positioned at a boundary between a portion to be deformed and a portion not to be deformed by the application of the voltage to both electrode layers (that is, a boundary between a portion functioning as the piezoelectric element in which the piezoelectric layer is sandwiched between both electrode layers and a portion in which the piezoelectric layer is not sandwiched between both electrode layers). There is a concern that damage such as cracks may result in the piezoelectric layer at the end of the second electrode layer due to the stress.

SUMMARY

An advantage of some aspects of the invention is to provide a MEMS system, a liquid ejecting head, and a liquid ejecting apparatus which suppresses damage to a dielectric layer such as a piezoelectric layer and an electrode layer stacked on the dielectric layer.

According to an aspect of the invention, a MEMS device includes a first substrate which includes a driving region and in which a first electrode layer, a dielectric layer, and a second electrode layer are stacked on the driving region in this order; and a second substrate which is disposed to face a surface on which the dielectric layer of the first substrate is stacked. The first electrode layer and the dielectric layer extend beyond the second electrode layer toward a non-driving region separated from the driving region, a first resin having elasticity is disposed in a region including an end of the second electrode layer in an extending direction of the dielectric layer, and the first substrate and the second substrate are fixed with an adhesive in a state where the elastically deformed first resin is sandwiched therebetween.

According to the configuration, since the end of the second electrode layer is pressed by the first resin, peeling of the end of the second electrode layer can be suppressed. In addition, since the deformation of the piezoelectric layer can be suppressed at the end portion of the second electrode layer, stress can be suppressed from concentrating on the piezoelectric layer at the end of the second electrode layer. As a result, the generation of cracks or the like in the piezoelectric layer can be suppressed.

In the configuration, it is preferable that a configuration be adopted in which a first conductive layer covering a surface of the first resin is formed in a state of being electrically insulated from the first electrode layer.

According to the configuration, a combined height of the first resin and the first conductive layer can be aligned with a height of a bump electrode in a configuration in which the bump electrode, which is made of a resin and the conductive layer, is provided between the first substrate and the second substrate. Accordingly, the end of the second electrode layer can be more reliably pressed.

In addition, in any of the configurations described above, it is preferable that a configuration be adopted in which the second substrate includes a third electrode layer which is electrically connected to the first electrode layer via a bump electrode, in which the bump electrode includes a second resin having elasticity and a second conductive layer covering a surface of the second resin, and in which the first resin and the second resin are disposed on the same substrate in any one substrate of the first substrate or the second substrate.

According to the configuration, manufacturing cost can be reduced since the first resin and the second resin can be produced in the same process.

Further, in any of the above configurations, it is preferable that a configuration be adopted in which the second substrate includes a third electrode layer which is electrically connected to the first electrode layer via the bump electrode, in which the bump electrode includes a second resin having elasticity and a second conductive layer covering a surface of the second resin, in which the first resin is disposed on any one substrate of the first substrate or the second substrate, and in which the second resin is disposed on the other substrate of the first substrate or the second substrate.

According to the configuration, an interval between the first resin and the second resin can be reduced, since the first resin and the second resin are disposed on different substrates from each other. As a result, the MEMS device can be miniaturized.

In addition, according to another aspect of the invention, a liquid ejecting head is the type of MEMS device of any of the above configurations and includes a pressure chamber of which at least a portion is divided by the driving region; and a nozzle which communicates with the pressure chamber.

According to the configuration, damage to the piezoelectric layer can be suppressed and reliability of the liquid ejecting head can be improved.

According to still another aspect of the invention, a liquid ejecting apparatus includes the liquid ejecting head having the above configuration.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an aspect for realizing the invention will be described with reference to the attached drawings. In the embodiments described below, although various limitations have been made as preferred specific examples of the invention, the scope of the invention is not limited to the aspects unless specifically stated to limit the invention. In addition, in the following description, among liquid ejecting heads which are one type of MEMS device, in particular, an ink jet-type recording head (hereinafter, recording head) 3 which is a type of liquid ejecting head mounted on an ink jet-type printer (hereinafter, printer) 1, which is a type of liquid ejecting apparatus, will be described as an example.

Figure 1:
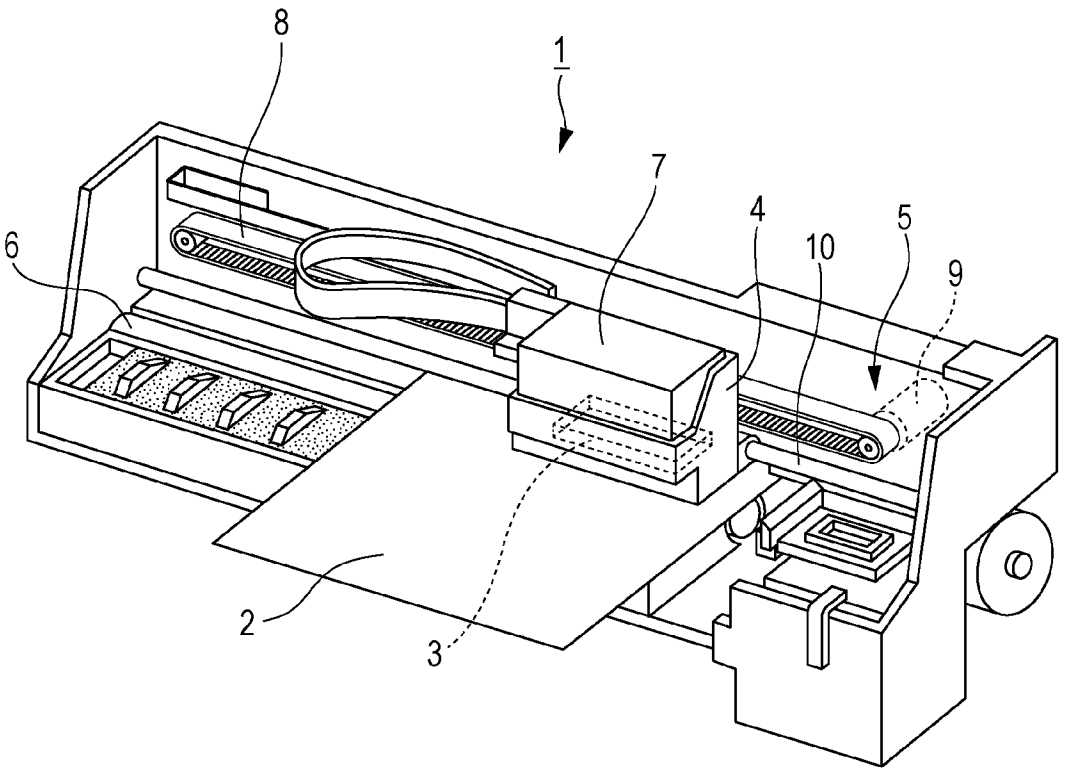
FIG. 1 is a perspective view illustrating a configuration of a printer.

FIG. 1 is a perspective view illustrating a configuration of the printer 1. The printer 1 is an apparatus for recording an image by ejecting ink (a kind of liquid) onto a surface of a recording medium 2 (a type of printing target) such as a recording paper. The printer 1 includes a recording head 3, a carriage 4 to which the recording head 3 is attached, a carriage moving mechanism 5 for moving the carriage 4 in a main scanning direction, a transport mechanism 6 for conveying the recording medium 2 in a sub scanning direction, and the like. Here, the ink is stored in an ink cartridge 7 as a liquid supply source. The ink cartridge 7 is detachably attached to the recording head 3. A configuration in which the ink cartridge is disposed on a main body of the printer and the ink is supplied from the ink cartridge to the recording head through an ink supply tube may be adopted.

The carriage moving mechanism 5 described above includes a timing belt 8. The timing belt 8 is driven by a pulse motor 9 such as a DC motor. Therefore, when the pulse motor 9 is operated, the carriage 4 is guided by a guide rod 10 installed in the printer 1 and reciprocates in the main scanning direction (width direction of recording medium 2). The position of the carriage 4 in the main scanning direction is detected by a linear encoder (not illustrated), which is a kind of position information detecting unit. The linear encoder transmits the detected signal, that is, encoder pulse (a type of position information) to a control portion of the printer 1.

Figure 2:
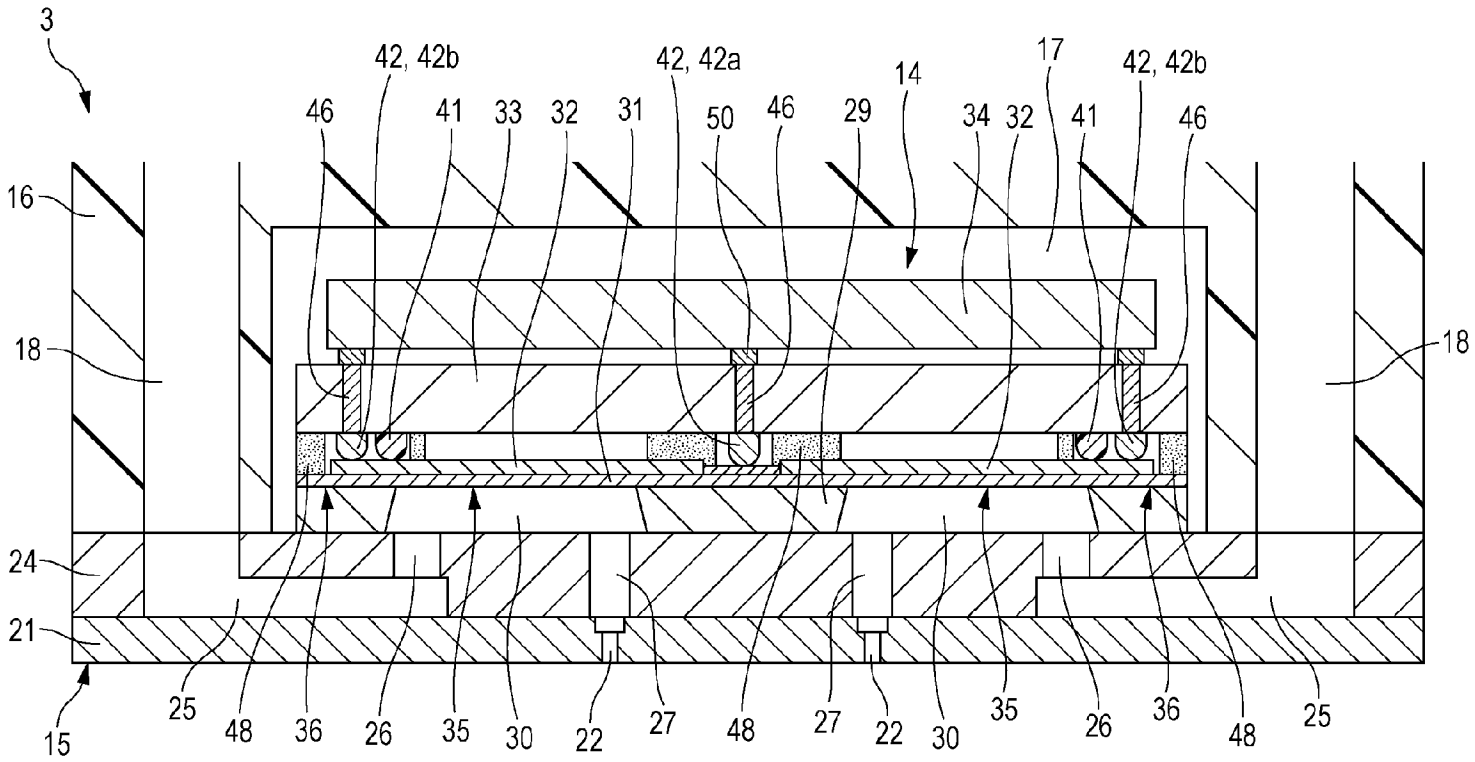
FIG. 2 is a cross-sectional view illustrating a configuration of a recording head.
Figure 3:
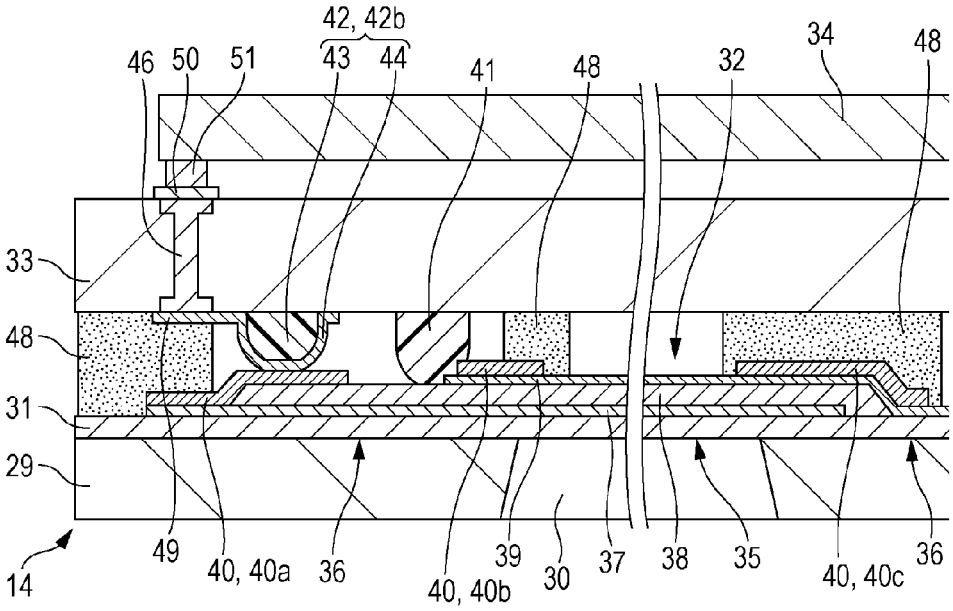
FIG. 3 is an enlarged cross-sectional view illustrating a main portion of the recording head.
Figure 4:
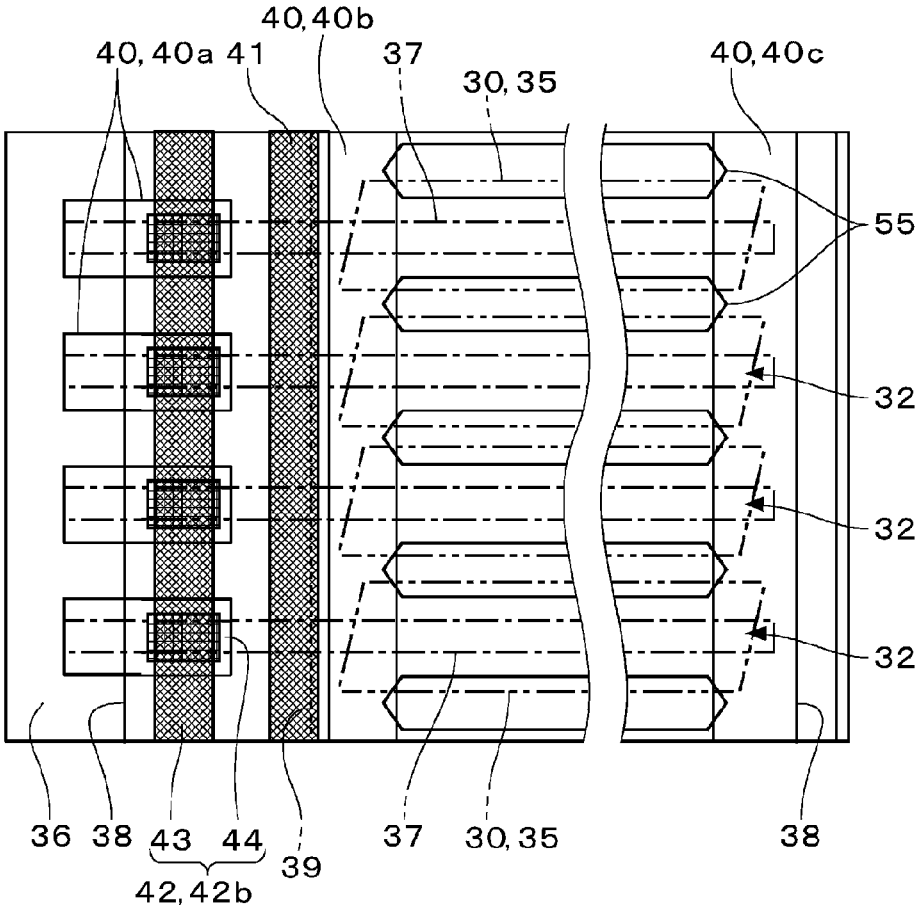
FIG. 4 is an enlarged plan view of the main portion of the recording head.

Next, the recording head 3 will be illustrated. FIG. 2 is a cross-sectional view illustrating a configuration of the recording head 3. FIG. 3 is an enlarged cross-sectional view of a main portion of the recording head 3, specifically, an enlarged cross-sectional view of an end portion of a side of an actuator unit 14. FIG. 4 is a plan view schematically illustrating the end portion of the side of the actuator unit 14. For convenience, a stacking direction of each member constituting the actuator unit 14 will be described as the vertical direction. As illustrated in FIG. 2, the recording head 3 in the present embodiment is attached to a head case 16 in a state where the actuator unit 14 and a flow path unit 15 are stacked.

The head case 16 is a box-shaped member made of a synthetic resin, and a liquid introduction path 18 for supplying an ink to each pressure chamber 30 is formed in an inside portion thereof. The liquid introduction path 18 is a space in which an ink common to a plurality of pressure chambers 30 is stored, along with a common liquid chamber 25 to be described below. In this embodiment, two liquid introduction paths 18 are formed in correspondence with the common liquid chamber 25 formed in two rows. In addition, an accommodating space 17 recessed in a rectangular parallelepiped shape from a lower surface thereof to a middle of the head case 16 in a height direction is formed on a lower surface side of the head case 16. The actuator unit 14 stacked on a communicating substrate 24 is configured to be accommodated inside the accommodating space 17 when the flow path unit 15 to be described below is adhered to a lower surface of the head case 16.

The flow path unit 15 adhered to a lower surface of the head case 16 includes the communicating substrate 24 on which a nozzle plate 21, in which a plurality of nozzles 22 are opened in a row, the common liquid chamber 25, or the like are provided. In this embodiment, the plurality of nozzles 22 (nozzle row) are formed in two rows. The nozzles 22 constituting the nozzle row are disposed from the nozzle 22 on one end side to the nozzle 22 on the other end side at equal intervals with a pitch corresponding to dot formation density. The common liquid chamber 25 is formed in an elongated shape as a common flow path for the plurality of pressure chambers 30 in a disposition direction (nozzle row direction) of the pressure chamber 30. In this embodiment, the common liquid chamber 25 is formed in two rows corresponding to the rows of the pressure chambers 30 formed in two rows. Each pressure chamber 30 and the common liquid chamber 25 communicate with each other via an individual communicating path 26 formed in the communicating substrate 24. In other words, the ink inside the common liquid chamber 25 is distributed to each pressure chamber 30 via respective individual communicating paths 26. In addition, the nozzle 22 and the pressure chamber 30 corresponding thereto communicate with each other via a nozzle communicating path 27 passing through the communicating substrate 24 in a plate thickness direction.

As illustrated in FIG. 2 and FIG. 3, a pressure chamber forming substrate 29, a vibrating plate 31, a piezoelectric element 32, a sealing plate 33, and a driving IC 34 are stacked on the actuator unit 14 in this order, and the actuator unit is accommodated inside the accommodating space 17 as a single unit. Since the piezoelectric elements 32 or the like corresponding to one nozzle row and the piezoelectric elements 32 or the like corresponding to the other nozzle row are formed substantially symmetrically in a lateral direction, hereinafter, the piezoelectric element 32 or the like is described by focusing on the piezoelectric elements 32 corresponding to one nozzle row or the like.

The pressure chamber forming substrate 29 is a hard plate made of silicon and is made of a silicon single crystal substrate of which surfaces (an upper surface and a lower surface) are (110) surfaces, for example. A portion of the pressure chamber forming substrate 29 is removed in a plate thickness direction thereof by etching so that a plurality of spaces to be the pressure chambers 30 corresponding to each nozzle 22 are formed in the nozzle row direction. In these spaces, the lower side thereof is divided by the communicating substrate 24 and the upper side thereof is divided by the vibrating plate 31, thereby constituting the pressure chamber 30. In addition, the pressure chamber 30 is formed in two rows corresponding to nozzle rows formed in two rows. Each pressure chamber 30 is formed in an elongated shape in a direction orthogonal to the nozzle row direction, the individual communicating path 26 communicates with an end portion of a side of the pressure chamber 30 in the longitudinal direction, and the nozzle communicating path 27 communicates with an end portion on the other side thereof. A side wall of the pressure chamber 30 in this embodiment is inclined with respect to an upper surface (or lower surface) of the pressure chamber forming substrate 29 due to the crystallinity of the silicon single crystal substrate.

The vibrating plate 31 is a thin film-shaped member having elasticity and is stacked on an upper surface (surface on the side opposite to the communicating substrate 24) of the pressure chamber forming substrate 29. An upper portion opening of the space to be the pressure chamber 30 is sealed by the vibrating plate 31. In other words, the upper surface, which is a portion of the pressure chamber 30, is divided by the vibrating plate 31. A region which divides the upper surface of the pressure chamber 30 in the vibrating plate 31 functions as a displacement portion which deforms (is displaced) in a direction away from or toward the nozzle 22 along with deflecting deformation of the piezoelectric element 32. In other words, a portion of the pressure chamber 30 in the vibrating plate 31, specifically the region dividing the upper surface thereof, becomes a driving region 35 in which deflecting deformation is permitted. On the other hand, a region (a region separated from driving region 35) separated from the upper portion opening of the space which is the pressure chamber 30 in the vibrating plate 31 is a non-driving region 36 in which deflecting deformation is inhibited. The vibrating plate 31 and the pressure chamber forming substrate 29 (in other words, pressure chamber forming substrate 29 on which the vibrating plate 31 is stacked) correspond to a first substrate in the invention. In addition, the vibrating plate 31 is formed by an elastic film made of silicon dioxide ($SiO_2$) formed on the upper surface of the pressure chamber forming substrate 29 and an insulating film made of zirconium dioxide ($ZrO_2$) formed on the elastic film, for example. The piezoelectric elements 32 are stacked at a position corresponding to the driving region 35 above the insulating film (surface on a side opposite to the pressure chamber 30 side of vibrating plate 31), respectively.

The piezoelectric elements 32 of this embodiment are piezoelectric elements of a so-called deflecting mode. The piezoelectric elements 32 are formed in two rows corresponding to the rows of the pressure chambers 30 formed in two rows. As illustrated in FIG. 3, a lower electrode layer 37, a piezoelectric layer 38 which is a kind of dielectric (insulator), and an upper electrode layer 39 are stacked on a vibrating plate 31 in this order in each piezoelectric element 32. In this embodiment, the lower electrode layer 37 is an individual electrode independently formed for each piezoelectric element 32, and the upper electrode layer 39 is a common electrode continuously formed over the plurality of piezoelectric elements 32. In other words, the lower electrode layer 37 and the piezoelectric layer 38 are individually formed for each pressure chamber 30 in the nozzle row direction. On the other hand, the upper electrode layer 39 is formed over the plurality of pressure chambers 30 in the nozzle row direction. In addition, in this embodiment, the lower electrode layer 37 and the piezoelectric layer 38 are formed in two rows corresponding to the rows of the pressure chambers 30 formed in two rows. Further, the upper electrode layer 39 in this embodiment is formed from a position corresponding to a row of the pressure chambers 30 on one side to a position corresponding to a row of the pressure chamber 30 on the other side. A metal layer 40 described below is stacked on the upper electrode layer 39. The lower electrode layer 37 corresponds to a first electrode layer in the invention and the piezoelectric layer 38 corresponds to the dielectric layer in the invention. In addition, the upper electrode layer 39 and the metal layer 40 stacked thereon correspond to a second electrode layer in the invention.

Here, the lower electrode layer 37 and the piezoelectric layer 38 extend from the driving region 35 beyond the lower electrode layer 37 toward the non-driving region 36 on one side (outside of the actuator unit 14; on the left side in FIG. 3) in the direction orthogonal to the nozzle row direction (in other words, in the longitudinal direction of pressure chambers 30). Specifically, as illustrated in FIG. 3 and FIG. 4, both ends of the lower electrode layer 37 in this embodiment extend from a region overlapping the pressure chamber 30, that is, the driving region 35 to a region beyond the pressure chamber 30, that is, the non-driving region 36 in the longitudinal direction of the pressure chamber 30. More specifically, the end on one side (left side in FIG. 3) of the lower electrode layer 37 extends beyond the end of the piezoelectric layer 38 on the side thereof. A first metal layer 40*a* to be described below is stacked on the lower electrode layer 37 beyond the end of the piezoelectric layer 38. In addition, an end on the other side (right side in FIG. 3) of the lower electrode layer 37 in the extending direction extends to the non-driving region 36 between the end of the driving region 35 and the end of the piezoelectric layer 38 on the other side thereof.

As in the lower electrode layer 37, both ends of the piezoelectric layer 38 in this embodiment extend from the region overlapping the pressure chamber 30 to the region beyond the pressure chamber 30 in the longitudinal direction of the pressure chamber 30. Specifically, one end of the piezoelectric layer 38 in this embodiment extends to the non-driving region 36 between the end of the upper electrode layer 39 and the end of the lower electrode layer 37 on the side thereof. In other words, the lower electrode layer 37 and the driving region 35 extend beyond the upper electrode layer 39 on one side of the piezoelectric element 32 in the longitudinal direction. The first metal layer 40*a* extending from a position overlapping with the lower electrode layer 37 is stacked on an end portion of the piezoelectric layer 38 beyond the upper electrode layer 39 in the non-driving region 36. In addition, the end on the other side of the piezoelectric layer 38 in the extending direction extends beyond the end of the lower electrode layer 37 on the other side thereof. Further, as illustrated in FIG. 4, in this embodiment, the non-driving region 36 (region between piezoelectric elements 32 which are adjacent to each other in the nozzle row direction) between the piezoelectric elements 32 in the nozzle row direction is the piezoelectric opening portion 55 formed by removal of the piezoelectric layer 38. In other words, the piezoelectric layer 38 is partitioned for each piezoelectric element 32 by the piezoelectric opening portion 55. The dimension of the piezoelectric opening portion 55 in the longitudinal direction (direction orthogonal to nozzle row direction) is shorter than the direction of the pressure chamber 30 in the longitudinal direction.

In the longitudinal direction of the pressure chamber 30, the upper electrode layer 39 in this embodiment is formed from the non-driving region 36 on one side (left side in FIG. 3) formed on the outside of the pressure chamber 30 over the non-driving region 36 on other side (right side in FIG. 3) formed beyond the pressure chamber 30. Specifically, as illustrated in FIG. 3, the end on one side of the upper electrode layer 39 in the extending direction is a region overlapping the piezoelectric layer 38 on one side among the piezoelectric layers 38 formed in two rows and extends to the non-driving region 36 beyond the driving region 35 on one side. More specifically, the end on one side of the upper electrode layer 39 in the extending direction extends to a region between the outer end of driving region 35 on one side and the outer end of piezoelectric layer 38 on one side. In addition, although not illustrated in the drawing, the end on the other side of the upper electrode layer 39 in the extending direction extends to a region between the outer end of the driving region 35 on the other side and the outer end of the piezoelectric layer 38 on the other side in a similar manner.

A region on which the entirety of the lower electrode layer 37, the piezoelectric layer 38, and the upper electrode layer 39 are stacked, in other words, a region in which the piezoelectric layer 38 is sandwiched between the lower electrode layer 37 and the upper electrode layer 39 functions as the piezoelectric element 32. Therefore, when an electric field corresponding to the potential difference between both electrodes of the lower electrode layer 37 and the upper electrode layer 39 is applied, the piezoelectric layer 38 is deflected and deformed in a direction away from or toward the nozzle 22 in the driving region 35, and the vibrating plate 31 of the driving region 35 is deformed. Deformation (displacement) is inhibited by the pressure chamber forming substrate 29 in a portion of the piezoelectric element 32 overlapping the non-driving region 36. A pressing resin 41 to be described below is in contact with the end of one side of the piezoelectric element 32 in the longitudinal direction in this embodiment, that is, the end of one side of the upper electrode layer 39. This point will be described later in detail.

In addition, as illustrated in FIG. 2 and FIG. 3, the metal layer 40 is formed on each piezoelectric element 32 on the end of one side of the piezoelectric element 32 in the longitudinal direction or on the piezoelectric layer 38 extending from each piezoelectric element 32. In this embodiment, the first metal layer 40*a* is stacked on a region straddling the end of the piezoelectric layer 38 on one side of the piezoelectric element 32 in the longitudinal direction, a second metal layer 40*b* is stacked on a region (that is, a region covering a boundary between the driving region 35 and the non-driving region 36 on one side) straddling the end on one side of the pressure chamber 30 of the piezoelectric element 32 in the longitudinal direction, and a third metal layer 40*c* is stacked on a region (that is, region covering boundary between driving region 35 and non-driving region 36 on the other side) straddling the end on the other side of the pressure chamber 30 of the piezoelectric element 32 in the longitudinal direction.

Specifically, the first metal layer 40*a* is an electrode layer having the same potential as that of the lower electrode layer 37 and extends from a region overlapping the end portion of the piezoelectric layer 38 in the longitudinal direction of the piezoelectric element 32 to a region overlapping the end portion on the other side of the lower electrode layer 37 in the longitudinal direction thereof beyond the end of the piezoelectric layer 38. In other words, the first metal layer 40*a* is stacked from the end portion of the lower electrode layer 37 over the end portion of the piezoelectric layer 38. In addition, the first metal layer 40*a* is formed to be spaced apart from the upper electrode layer 39 stacked on the piezoelectric layer 38. The second metal layer 40*b* is an electrode layer having the same potential as that of the upper electrode layer 39 and extends from a region overlapping the end portion on one side of the pressure chamber 30 in the longitudinal direction of the piezoelectric element 32 to a region overlapping the end portion on one side of the upper electrode layer 39 beyond the end on one side of the pressure chamber 30. The end on one side of the second metal layer 40*b* in this embodiment is formed on the inside (pressure chamber 30 side) of the end on one side of the upper electrode layer 39. In short, the second metal layer 40*b* is stacked on the end portion on one side of the upper electrode layer 39 in the longitudinal direction of the piezoelectric element 32. The third metal layer 40*c* is an electrode layer having the same potential as that of the upper electrode layer 39 and extends from a region overlapping the end portion on the other side of the pressure chamber 30 in the longitudinal direction of the piezoelectric element 32 to a region in which only the upper electrode layer 39 is stacked on the vibrating plate 31 beyond the end on the other side of the pressure chamber 30 and the end on the other side of the piezoelectric layer 38. As in the upper electrode layer 39, the second metal layer 40*b* and the third metal layer 40*c* are formed over the plurality of pressure chambers 30 in the nozzle row direction.

Various metals such as iridium (Ir), platinum (Pt), titanium (Ti), tungsten (W), nickel (Ni), palladium (Pd), and gold (Au), and alloys thereof, alloys such as $LaNiO_3$ are used as the lower electrode layer 37 and the upper electrode layer 39. In addition, a ferroelectric piezoelectric material such as lead zirconate titanate (PZT), a relaxor ferroelectric which is added metals such as niobium (Nb), nickel (Ni), magnesium (Mg), bismuth (Bi) or yttrium (Y) to the ferroelectric piezoelectric material, or the like is used as the piezoelectric layer 38. In addition, lead-free materials such as barium titanate can also be used as the piezoelectric layer 38. Further, Gold (Au), copper (Cu), an alloy thereof or the like is used as the metal layer 40. In a case where the metal layer is made of gold (Au) or the like, a contact layer made of titanium (Ti), nickel (Ni), chromium (Cr), tungsten (W), alloy thereof, and the like may be provided on the lower side of the metal layer. In this case, the upper electrode layer, the contact layer and the metal layer correspond to the second electrode layer in the invention.

The sealing plate 33 (corresponding to second substrate in the invention) is a flat plate-like substrate disposed to be spaced apart from the vibrating plate 31 so that the deformation of the piezoelectric element 32 which is disposed between the vibrating plate 31 the sealing plate 33 is not inhibited. As illustrated in FIG. 2 and FIG. 3, in the sealing plate 33 in this embodiment, the pressing resin 41 (corresponding to first resin in the invention) and a bump electrode 42 are formed on a surface of a side facing the piezoelectric element 32. The sealing plate 33 is adhered to an upper surface (that is, surface on which piezoelectric element 32 is stacked) of the pressure chamber forming substrate 29 (specifically, vibrating plate 31 stacked on pressure chamber forming substrate 29) in a state of being interposed between the pressing resin 41 and the bump electrode 42. In this embodiment, the sealing plate 33 and the pressure chamber forming substrate 29 are adhered by an adhesive 48 having both thermosetting properties and photosensitive properties. As illustrated in FIG. 2, there are two kinds of bump electrodes 42 which are a common bump electrode 42*a* electrically connected to the upper electrode layer 39 and an individual bump electrode 42*b* electrically connected to the lower electrode layer 37 and the bump electrodes are connected to the electrode layer corresponding to an elastically deformed state, respectively. As illustrated in FIG. 3, an internal resin 43 (corresponding to second resin in the invention) made of an elastic synthetic resin and a conductive layer 44 (corresponding to second conductive layer in the invention) made of a metal covering a surface of the internal resin 43 are stacked on both bump electrodes 42*a* and 42*b*.

In this embodiment, as illustrated in FIG. 2, a row of the common bump electrode 42*a* which supplies a voltage common to the piezoelectric elements 32 of both sides is formed on a position corresponding to between the two rows of the piezoelectric elements 32, and the individual bump electrode 42*b* which supplies individual voltage to each of the piezoelectric elements 32 is formed by one row respectively at a position corresponding to the outside (specifically, side opposite to common bump electrode 42*a* with piezoelectric element 32 interposed therebetween)of the row of the piezoelectric elements 32 on one side and a position corresponding to the outside of the row of the piezoelectric elements 32 on the other side. The common bump electrode 42*a* is connected to the upper electrode layer 39 extending from the piezoelectric element 32. In other words, the conductive layer 44 of the common bump electrode 42*a* is in contact with the upper electrode layer 39. In addition, the conductive layer 44 is connected to a corresponding driving IC side terminal 50 formed on the upper surface (surface of driving IC 34 side) of the sealing plate 33 via a through wiring 46 passing through the sealing plate 33 in the plate thickness direction.

The individual bump electrode 42*b* is connected to the first metal layer 40*a* at a position overlapping the piezoelectric layer 38. In other words, as illustrated in FIG. 3 and FIG. 4, the conductive layer 44 of the individual bump electrode 42*b* is in contact with the first metal layer 40*a*. The internal resin 43 of the individual bump electrode 42*b* in this embodiment is disposed as a ridge in the nozzle row direction on the lower surface of the sealing plate 33. On the other hand, a plurality of the conductive layers 44 of the individual bump electrodes 42*b* are formed in the nozzle row direction corresponding to the piezoelectric elements 32 juxtaposed in the nozzle row direction. In other words, a plurality of individual bump electrodes 42*b* are formed in the nozzle row direction. In addition, the conductive layer 44 of each individual bump electrode 42*b* constitutes a piezoelectric element side electrode layer 49 (corresponding to third electrode layer in the invention) by extending beyond the internal resin 43 on the lower surface of the sealing plate 33 (surface of piezoelectric elements 32 side). An end portion of a side opposite to the individual bump electrode 42*b* of the piezoelectric element side electrode layer 49 is connected to the through wiring 46. In other words, the piezoelectric element side electrode layer 49 connecting the through wiring 46 and the individual bump electrode 42*b* is routed to a position overlapping with the internal resin 43 to become the conductive layer 44 of the individual bump electrode 42*b*. In other words, the piezoelectric element side electrode layer 49 is ellectrically connected to the first metal layer 40*a* (that is, lower electrode layer 37) via the individual bump electrode 42*b*. The piezoelectric element side electrode layer 49 is connected to the corresponding driving IC side terminal 50 formed on the upper surface of the sealing plate 33 via the through wiring 46.

As illustrated in FIG. 2, the pressing resin 41 is disposed in two rows corresponding to the rows of piezoelectric elements 32 formed in two rows. As illustrated in FIG. 3 and FIG. 4, the pressing resin 41 is disposed in a ridge in the nozzle row direction on a position corresponding to the end of the upper electrode layer 39 of the outside (the individual bump electrode 42*b* side) in the longitudinal direction (that is, in extending direction of piezoelectric layer 38) of the piezoelectric element 32 on the lower surface of the sealing plate 33. More specifically, the pressing resin 41 projects from the end portion of the second metal layer 40*b* to a region of the lower surface of the sealing plate 33 facing a region (that is, region including end of upper electrode layer 39) over the piezoelectric layer 38 between the second metal layer 40*b* and the first metal layer 40*a* in the longitudinal direction of the piezoelectric element 32. The pressing resin 41 is in contact with the end portion of the upper electrode layer 39 in an elastically deformed state. In other words, the pressing resin 41 is in contact with the end portion of the upper electrode layer 39 in a state of being sandwiched between the sealing plate 33 and the pressure chamber forming substrate 29 and being collapsed in the height direction. In short, the sealing plate 33 and the pressure chamber forming substrate 29 are fixed with the adhesive 48 in a state of being elastically deformed while sandwiching the pressing resin 41 and the bump electrode 42 therebetween. A resin having elasticity such as polyimide resin is used as the internal resin 43 and the pressing resin 41, for example.

By configuring as described above, since the end of the upper electrode layer 39 and the end of the second metal layer 40*b* are pressed by the pressing resin 41, peeling of the upper electrode layer 39 and the second metal layer 40*b* can be suppressed. In addition, since deformation of the piezoelectric layer 38 at the end portion of the upper electrode layer 39 can be suppressed, concentration of stress on the piezoelectric layer 38 at the end of the upper electrode layer 39 can be suppressed. Accordingly, generation of cracks or the like in the piezoelectric layer 38 can be suppressed. As a result, the reliability of the recording head 3 can be improved and in turn the reliability of the printer 1 can be improved.

As illustrated in FIG. 3, in the longitudinal direction of the piezoelectric element 32, the adhesive 48 in this embodiment is disposed on a region including a boundary between the driving region 35 and the non-driving region 36 at the end portion on one side of the pressure chamber 30, a region including a boundary between the driving region 35 and the non-driving region 36 at the end portion on the other side of the pressure chamber 30, and the non-driving region 36 of the outside of the individual bump electrode 42*b*, and the sealing plate 33 and the pressure chamber forming substrate 29 are adhered and fixed to each other at each of the regions. In addition, these adhesives 48 are disposed on the positions which are separated from the bump electrodes 42 and the pressing resin 41 so as not to adhere thereto.

The driving IC 34 is an IC chip which outputs a signal for driving the piezoelectric element 32, and is stacked on the upper surface of the sealing plate 33 via an adhesive (not illustrated) such as an anisotropic conductive film (ACF). As illustrated in FIG. 3, an IC bump electrode 51 connected to the driving IC side terminal 50 is formed on the surface of the driving IC 34 on the sealing plate 33 side. Each IC bump electrode 51 projects from the lower surface of the driving IC 34 toward the sealing plate 33 side.

In the recording head 3 configured as described above, ink from the ink cartridge 7 is introduced into the pressure chamber 30 via the liquid introduction path 18, the common liquid chamber 25, the individual communicating path 26, and the like. In this state, the piezoelectric element 32 is driven and pressure variation is generated in the pressure chamber 30 by the driving signal from the driving IC 34 being supplied to the piezoelectric element 32 via wiring or the like formed on the sealing plate 33. By using this pressure fluctuation, the recording head 3 ejects ink droplets from the nozzle 22 via the nozzle communicating path 27.

Figure 5:
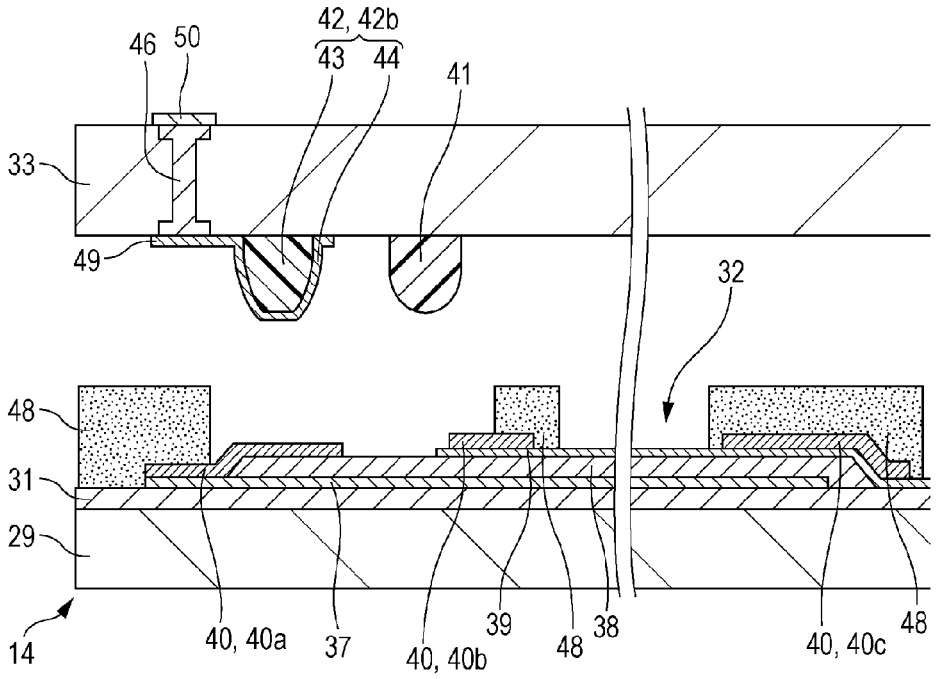
FIG. 5 is a schematic view illustrating a method of manufacturing an actuator unit.
Figure 6:
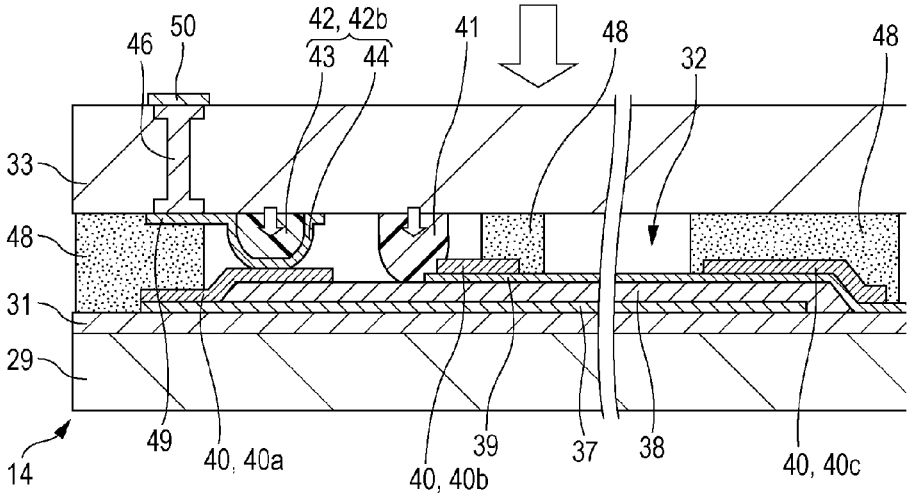
FIG. 6 is a schematic view illustrating the method of manufacturing the actuator unit.

Next, a method of manufacturing the recording head 3 described above, particularly the actuator unit 14 will be described. FIG. 5 and FIG. 6 are schematic views for explaining the manufacturing method of the actuator unit 14. In a silicon single crystal substrate to be the sealing plate 33 (hereinafter simply referred to as sealing plate 33), first, a through hole passing through the sealing plate 33 is formed by using etching, laser, or the like, and thereafter the through wiring 46 is formed in the through hole by an electrolytic plating method or the like. In addition, an IC bump electrode 51 or the like are formed on the upper surface of the sealing plate 33 by using a semiconductor process (that is, film forming process, photolithography process, etching process, and the like). Further, a resin core bump and the pressing resin 41 are formed on the lower surface of the sealing plate 33 by using a semiconductor process. More specifically, a resin film is formed on the lower surface of the sealing plate 33, a resin is disposed at a predetermined position by a photolithography process and an etching process, the resin is melted by heating and the corner is rounded and thus an internal resin 43 and the pressing resin 41 are disposed. Thereafter, a metal film is formed on the surface by vapor deposition, sputtering or the like, and the conductive layer 44 is formed by a photolithography process and an etching process. Accordingly, as illustrated in FIG. 5, the bump electrode 42 is formed at a predetermined position. Thereafter, the exposed portion of the internal resin 43 and a portion of the surface of the pressing resin 41 can be scraped off by ashing or a method using a chemical solution.

On the other hand, in the silicon single crystal substrate to be the pressure chamber forming substrate 29 (hereinafter simply referred to as pressure chamber forming substrate 29), first, the vibrating plate 31 is stacked on the upper surface. Next, the lower electrode layer 37, the piezoelectric layer 38, the upper electrode layer 39, and the metal layer 40 are sequentially patterned on the vibrating plate 31 by a semiconductor process to form the piezoelectric element 32 or the like. Thereafter, an adhesive layer is formed on the surface, and the adhesive 48 is formed at a predetermined position by a photolithography process. Specifically, a liquid adhesive having photosensitivity and thermosetting property is applied on the vibrating plate 31 using a spin coater or the like and heated to form an adhesive layer having elasticity. By exposure and development, as illustrated in FIG. 5, the shape of the adhesive 48 is patterned at a predetermined position. In this embodiment, since the adhesive 48 has photosensitivity, the adhesive 48 can be patterned with high accuracy by the photolithography process. The adhesive 48 can be formed on the sealing plate 33 side without being formed on the pressure chamber forming substrate 29 side.

When the adhesive 48 is formed, the sealing plate 33 and the pressure chamber forming substrate 29 are adhered to each other. Specifically, as illustrated in FIG. 6, any one of the substrates (sealing plate 33 in this embodiment) is relatively moved toward the other of the substrates (see arrow in FIG. 6), and the adhesive 48 is sandwiched between the both substrates and the both substrates are bonded. In this state, the sealing plate 33 and the pressure chamber forming substrate 29 are pressed in the vertical direction against the elastic restoring force of the bump electrode 42 and the pressing resin 41. Accordingly, as illustrated in FIG. 6, the bump electrode 42 and the pressing resin 41 are pressed and are in collapsed state. The bump electrode 42 and the pressing resin 41 are heated to the curing temperature of the adhesive 48 while applying pressure. As a result, the adhesive 48 is cured in a state where the bump electrode 42 and the pressing resin 41 are collapsed (that is, in a state of being elastically deformed), and the sealing plate 33 and the pressure chamber forming substrate 29 are adhered to each other. In other words, the sealing plate 33 and the pressure chamber forming substrate 29 are fixed to each other in a state where the end of the upper electrode layer 39 and the end of the second metal layer 40*b* are pressed by the pressing resin 41.

When the sealing plate 33 and the pressure chamber forming substrate 29 are adhered to each other, the pressure chamber 30 is formed in the pressure chamber forming substrate 29 by a photolithography process and an etching process. In this way, the actuator unit 14 as described above is formed. When the actuator unit 14 is formed, the actuator unit 14 and the flow path unit 15 are positioned and fixed with an adhesive or the like. The recording head 3 is manufactured by adhering the head case 16 and the flow path unit 15 to each other in a state where the actuator unit 14 is accommodated in the accommodating space 17 of the head case 16.

As described above, in this embodiment, since the bump electrode 42 and the pressing resin 41 are formed on the same substrate (sealing plate 33 in this embodiment), the internal resin 43 and the pressing resin 41 can be produced in the same process. Therefore, compared to a case where the internal resin 43 and the pressing resin 41 are produced in different processes from each other, the manufacturing cost can be reduced. A configuration in which the metal layer 40 is not stacked on the upper electrode layer 39 can also be adopted. In this case, only the upper electrode layer 39 corresponds to the second electrode layer in the invention.

In the first embodiment described above, since the height of the bump electrode 42 and the height of the pressing resin 41 are different from each other by the height of the conductive layer 44, there is a concern that the pressing resin 41 can not sufficiently press the end of the upper electrode layer 39 unless pressurization is sufficiently performed between the sealing plate 33 and the pressure chamber forming substrate 29. In particular, in a case where the exposed portion of the internal resin 43 and a portion of the surface of the pressing resin 41 are removed by ashing or the like after the bump electrode 42 is formed, there is a concern that the difference between the height of the bump electrode 42 and the height of the pressing resin 41 is further increased. Therefore, in a second embodiment illustrated in FIG. 7, for the purpose of aligning with the height of the bump electrode 42 and the height of the pressing resin 41, a pressing conductive layer 53 (first conductive layer in the invention) is formed on the surface of the pressing resin 41.

Figure 7:
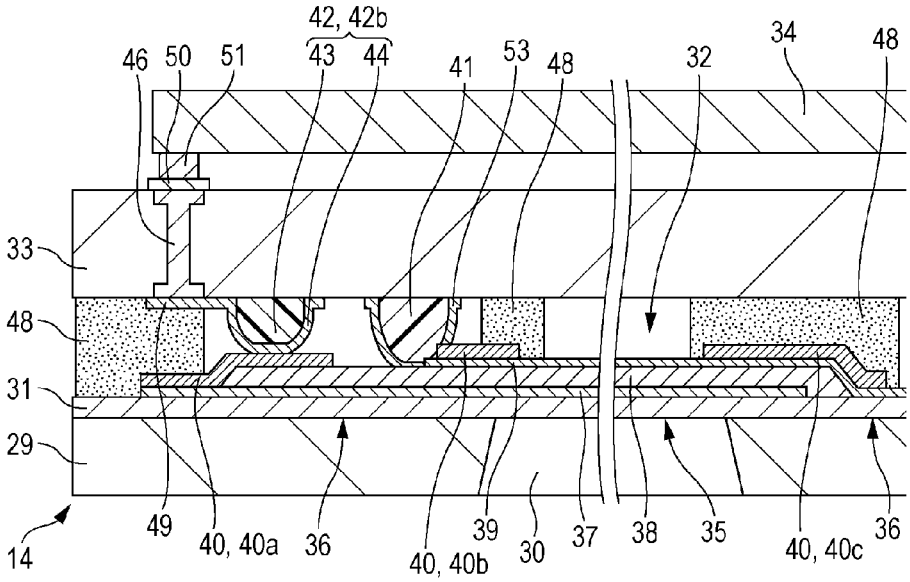
FIG. 7 is an enlarged cross-sectional view of a main portion of a recording head according to a second embodiment.

Specifically, as illustrated in FIG. 7, the pressing conductive layer 53 is formed so as to cover the surface of the pressing resin 41. The pressing conductive layer 53 is formed to be spaced apart from the conductive layer 44 of the individual bump electrode 42*b* electrically connected to the lower electrode layer 37 and other electrode layers (not illustrated). In other words, the pressing conductive layer 53 is formed in a state of being electrically insulated from the lower electrode layer 37. As in the first embodiment, the pressing resin 41 in this embodiment is formed in a ridge in the nozzle row direction on the lower surface of the sealing plate 33. In addition, as in the conductive layer 44 of the individual bump electrode 42*b*, a plurality of pressing conductive layers 53 are formed in the nozzle row direction corresponding to the piezoelectric elements 32 juxtaposed in the nozzle row direction. In other words, the pressing conductive layer 53 is formed for each piezoelectric element 32. The pressing conductive layer 53 can also be provided over the plurality of piezoelectric elements 32, that is, continuously in the nozzle row direction, as in the pressing resin 41.

The pressing conductive layer 53 in this embodiment is in contact with a region including the end of the upper electrode layer 39 in a state where the pressing resin 41 of the inner side of the pressing conductive layer is elastically deformed. In this manner, since the pressing resin 41 presses the end of the upper electrode layer 39 via the pressing conductive layer 53, the amount of elastic deformation of the pressing resin 41 is increased as compared with a case where there is no the pressing conductive layer 53. In short, the combined height of the pressing resin 41 and the pressing conductive layer 53 can be aligned with the height of the bump electrode 42. Therefore, the end of the upper electrode layer 39 and the end of the second metal layer 40*b* can be more reliably pressed. As a result, peeling of the upper electrode layer 39 and the second metal layer 40*b* can be suppressed, and in addition, generation of cracks or the like in the piezoelectric layer 38 can be suppressed. Further, even in a case where the exposed portion of the internal resin 43 and a portion of the surface of the pressing resin 41 are removed by ashing or the like after the bump electrode 42 is formed, since the pressing resin 41 is protected by the pressing conductive layer 53, the combined height of the pressing resin 41 and the pressing conductive layer 53 can be aligned with the height of the bump electrode 42. Since other configurations are the same as those of the first embodiment, the description thereof will be omitted. In addition, with respect to the manufacturing method according to this embodiment, since the pressing conductive layer 53 is manufactured at the same process as the process of forming the conductive layer 44 and the other processes are the same as those of the first embodiment described above, the description is omitted.

In addition, in the first embodiment described above, although both the bump electrode 42 and the pressing resin 41 are formed on the sealing plate 33, the invention is not limited thereto. In third to fifth embodiments illustrated in FIG. 8 to FIG. 10, any one or both of the bump electrodes 42 and the pressing resin 41 are formed on the pressure chamber forming substrate 29.

Figure 8:
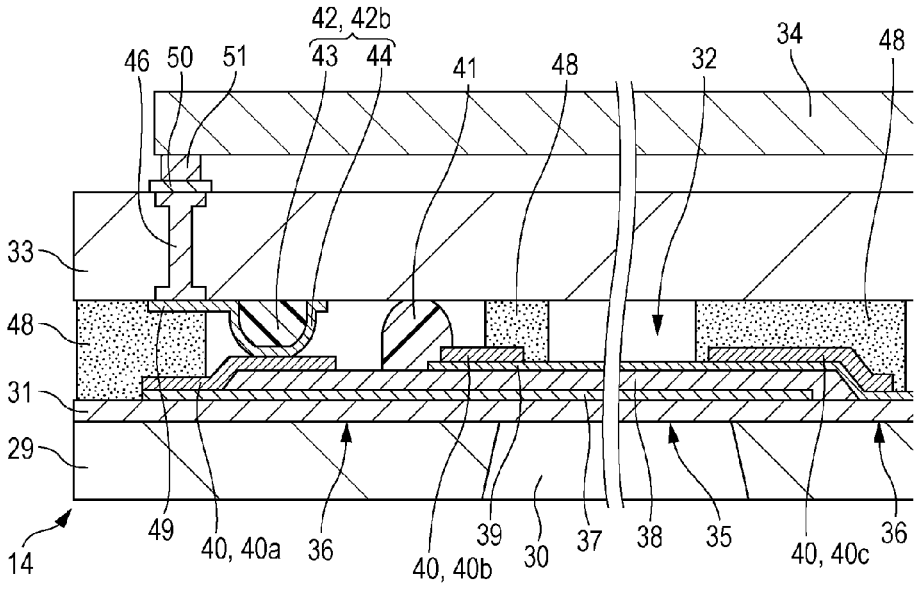
FIG. 8 is an enlarged cross-sectional view of a main portion of a recording head according to a third embodiment.

Specifically, in the third embodiment illustrated in FIG. 8, the bump electrode 42 is formed on the sealing plate 33 side as in the first embodiment, whereas the pressing resin 41 is formed on the pressure chamber forming substrate 29 side unlike the first embodiment. The pressing resin 41 in this embodiment is disposed in a ridge in the nozzle row direction at a position corresponding to the end of upper electrode layer 39 beyond the piezoelectric element 32 in the longitudinal direction on the upper surface of the pressure chamber forming substrate 29. More specifically, the pressing resin 41 is stacked on a region (that is, region including end of upper electrode layer 39) from the end portion of the second metal layer 40*b* over the piezoelectric layer 38 between the second metal layer 40*b* and the first metal layer 40*a* in the longitudinal direction of the piezoelectric element 32. The pressing resin 41 in this embodiment is also in contact with the lower surface of the sealing plate 33 in an elastically deformed state. Accordingly, also in this embodiment, the end of the upper electrode layer 39 and the end of the second metal layer 40*b* can be pressed by the pressing resin 41 and generation of defects such as peeling of the upper electrode layer 39 and the second metal layer 40*b* and cracks of the piezoelectric layer 38 can be suppressed. In addition, in this embodiment, since the pressing resin 41 is disposed on a region including the end of the upper electrode layer 39, even if the relative position between the pressure chamber forming substrate 29 and the sealing plate 33 is shifted due to a manufacturing error or the like, the end of the upper electrode layer 39 can be reliably pressed. Further, since the bump electrodes 42 and the pressing resin 41 are disposed on different substrates, the interval between the bump electrodes 42 and the pressing resin 41 can be reduced as much as possible. As a result, the actuator unit 14 can be miniaturized, and in turn the recording head 3 can be miniaturized. Since other configurations are the same as those of the first embodiment, the description thereof will be omitted.

A method of manufacturing the actuator unit 14 in this embodiment will be described. In this embodiment, in the process of forming the internal resin 43 of the resin core bump on the lower surface of the sealing plate 33, while the pressing resin 41 is not disposed, after the piezoelectric element 32 or the like is formed on the pressure chamber forming substrate 29, a process of disposing the internal resin 43 is added. Specifically, after the piezoelectric element 32 or the like are formed on the pressure chamber forming substrate 29 by a semiconductor process, a resin film is formed on the upper surface of the pressure chamber forming substrate 29. After a resin is disposed at a predetermined position by a photolithography process and an etching process, the corner is rounded by heating to dispose the internal resin 43. Since the sealing plate 33 side merely changes the formation pattern of the resin, the description will be omitted. In addition, since the other manufacturing methods are the same as those in the first embodiment, the description thereof will be omitted.

Figure 9:
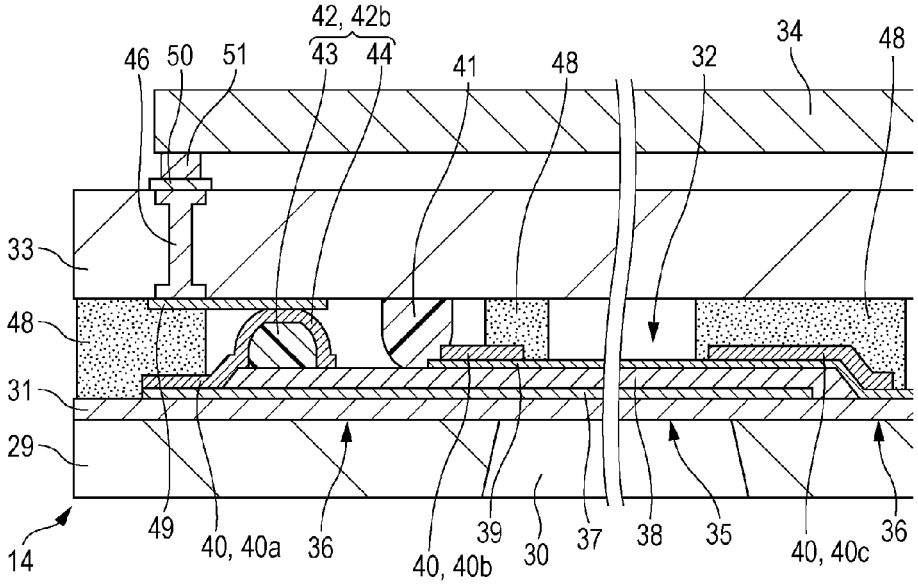
FIG. 9 is an enlarged cross-sectional view of a main portion of a recording head according to a fourth embodiment.

In addition, in the fourth embodiment illustrated in FIG. 9, while the pressing resin 41 is disposed on the sealing plate 33 as in the first embodiment, the bump electrode 42 is formed on the pressure chamber forming substrate 29 side unlike the first embodiment. As illustrated in FIG. 9, the internal resin 43 of the individual bump electrode 42*b* in this embodiment is disposed in a ridge in the nozzle row direction at one end portion on one side of the piezoelectric layer 38 in the longitudinal direction of the piezoelectric element 32. A plurality of conductive layers 44 of the individual bump electrodes 42*b* are formed on the internal resin 43 in the nozzle row direction. In addition, the conductive layer 44 of each individual bump electrode 42*b* extends beyond the internal resin 43 to constitute the first metal layer 40*a*. In other words, the first metal layer 40*a* stacked on the lower electrode layer 37 is routed to a position overlapping with the internal resin 43 to become the conductive layer 44 of the individual bump electrode 42*b*. On the other hand, in this embodiment, the piezoelectric element side electrode layer 49 extends from a position overlapping the through wiring 46 to a position with which the individual bump electrode 42*b* is in contact in a position separated from the pressing resin 41 on the lower surface of the sealing plate 33. Each individual bump electrode 42*b* is in contact with the corresponding piezoelectric element side electrode layer 49 in an elastically deformed state. Accordingly, the piezoelectric element side electrode layer 49 is electrically connected to the lower electrode layer 37 via the individual bump electrode 42*b*. Although not illustrated in the drawings, the common bump electrode in this embodiment has an internal resin stacked on the upper electrode layer 39 and a conductive film covering the internal resin and electrically connected to the upper electrode layer between the rows of piezoelectric elements 32 and is connected to the piezoelectric element side electrode layer which is electrically connected to the through wiring 46 in an elastically deformed state. As described above, also in this embodiment, since the bump electrode 42 and the pressing resin 41 are disposed on different substrates, the interval between the bump electrode 42 and the pressing resin 41 can be reduced as much as possible. As a result, the actuator unit 14 can be miniaturized, and in turn the recording head 3 can be miniaturized. Since other configurations are the same as those of the first embodiment, the description thereof will be omitted.

A method of manufacturing the actuator unit 14 in this embodiment will be described. In this embodiment, in the process of disposing the pressing resin 41 on the lower surface of the sealing plate 33, while the internal resin 43 of the bump electrode 42 is not disposed, after the piezoelectric element 32 is formed on the pressure chamber forming substrate 29, a process of disposing the internal resin 43 of the bump electrode 42 is added. Specifically, a resin film is formed on the upper surface of the pressure chamber forming substrate 29 before the metal layer 40 is formed and after the piezoelectric element 32 is formed on the pressure chamber forming substrate 29 by a semiconductor process. The corner is rounded by heating to dispose the internal resin 43 after a resin is disposed at a predetermined position by a photolithography process and an etching process. Thereafter, the bump electrode 42 is formed, by the metal layer 40 being formed by a semiconductor process. Since the sealing plate 33 side merely changes the formation pattern of the resin, the description thereof will be omitted. In addition, since the other manufacturing methods are the same as those in the first embodiment, the description thereof will be omitted.

Figure 10:
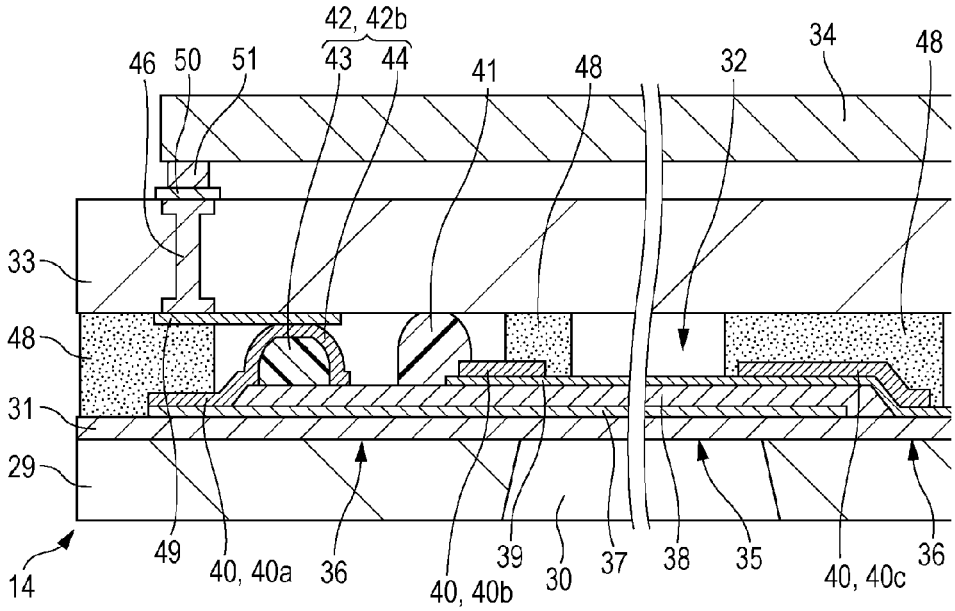
FIG. 10 is an enlarged cross-sectional view of a main portion of a recording head according to a fifth embodiment.

Further, in the fifth embodiment illustrated in FIG. 10, unlike the first embodiment, the bump electrode 42 and the pressing resin 41 are formed on the pressure chamber forming substrate 29 side. As in the fourth embodiment, the internal resin 43 of the individual bump electrode 42*b* in this embodiment is disposed in a ridge in the nozzle row direction at the end portion on one side of the piezoelectric layer 38 in the longitudinal direction of the piezoelectric element 32. In addition, as in the fourth embodiment, the first metal layer 40*a* stacked on the lower electrode layer 37 is routed to a position which overlaps the internal resin 43 in the conductive layer 44 of the individual bump electrode 42*b*. Further, as in the third embodiment, the pressing resin 41 is disposed in a ridge in the nozzle row direction at a position corresponding to the end of the upper electrode layer 39 beyond the piezoelectric element 32 in the longitudinal direction on the upper surface of the pressure chamber forming substrate 29.

A method of manufacturing the actuator unit 14 in this embodiment will be described. In this embodiment, while there is no process of forming the resin (internal resin 43 and pressing resin 41) on the lower surface of the sealing plate 33, after the piezoelectric element 32 or the like is formed on the pressure chamber forming substrate 29, a process of disposing the internal resin 43 of the bump electrode 42 and the pressing resin 41 is added. Specifically, after the piezoelectric element 32 is formed on the pressure chamber forming substrate 29 by a semiconductor process, and the second metal layer 40*b* and the third metal layer 40*c* are formed, the resin film is formed on the upper surface of the pressure chamber forming substrate 29. Then, after a resin is disposed at a predetermined position, the corner is rounded by heating to dispose the internal resin 43 and the pressing resin 41, by a photolithography process and an etching process. Thereafter, the bump electrode 42 is formed by the first metal layer 40*a* being formed by a semiconductor process. Since there is merely no a resin patterning process with respect to the sealing plate 33 side, the description will be omitted. In addition, since the other manufacturing methods are the same as those in the first embodiment, the description thereof will be omitted. As described above, also in this embodiment, since the bump electrode 42 and the pressing resin 41 are formed on the same substrate (pressure chamber forming substrate 29 in this embodiment), the internal resin 43 and the pressing resin 41 can be produced in the same process. Therefore, the manufacturing cost can be reduced as compared with a case where the internal resin 43 and the pressing resin 41 are produced in different processes. In addition, in this embodiment, since the pressing resin 41 is disposed in a region including the end of the upper electrode layer 39, even if the relative position between the pressure chamber forming substrate 29 and the sealing plate 33 is shifted due to manufacturing error or the like, the end of the upper electrode layer 39 can be reliably pressed. In the third to fifth embodiments, as in the second embodiment, the height can be adjusted by providing a pressing conductive layer on the surface of the pressing resin.

In the above description, although a configuration in which ink, which is a kind of liquid, from the nozzle 22 is ejected by the driving region 35 in which the piezoelectric element 32 is formed being displaced by the drive of the piezoelectric element 32 is described as an example, the invention is not limited thereto and if the MEMS device includes a first substrate in which a first electrode layer, a dielectric layer and a second electrode layer are stacked on a driving region in this order, and a second substrate which is disposed to face the first substrate it is possible to apply to the invention. For example, the invention can be applied to a sensor or the like for detecting pressure change, vibration, displacement or the like in a driving region. The space in which one surface is divided by the driving region is not limited to the space through which the liquid flows.

In addition, in the above embodiment, although the ink jet-type recording head 3 is described as an example of the liquid ejecting head, the invention can be also applied to other liquid ejecting heads. The invention can be applied to a color material ejecting head which is used for manufacturing a color filter of a liquid crystal display or the like, an electrode material ejecting head which is used for forming an electrode of an organic electro luminescence (EL) display, a face emitting display (FED), or the like, a bioorganic ejecting head which is used for manufacturing a biochip (biochemical element) or the like, for example. A solution of each color material of red (R), green (G), and blue (B) is ejected as a kind of liquid from a color material ejecting head of the display manufacturing apparatus. In addition, a liquid electrode material is injected as a kind of liquid from the electrode material ejecting head of an electrode forming apparatus, and a solution of bioorganic matter is ejected as a kind of liquid from the bioorganic ejecting head of a chip manufacturing apparatus.

What is claimed is:

1. A MEMS device, comprising:

a first substrate which includes a driving region and in which a first electrode layer, a dielectric layer, and a second electrode layer are stacked on the driving region in this order; and a second substrate which is disposed to face a surface on which the dielectric layer of the first substrate is stacked, wherein the first electrode layer and the dielectric layer extend beyond the second electrode layer toward a non-driving region separated from the driving region, wherein a first resin having elasticity is disposed in a region including an end of the second electrode layer in an extending direction of the dielectric layer, and wherein the first substrate and the second substrate are fixed with an adhesive in a state where the elastically deformed first resin is sandwiched therebetween.

2. The MEMS device according to claim 1, wherein a first conductive layer covering a surface of the first resin is formed in a state of being electrically insulated from the first electrode layer.

3. A liquid ejecting head which is the type of MEMS device according to claim 2, the head comprising:

a pressure chamber of which at least a portion is divided by the driving region; and a nozzle which communicates with the pressure chamber.

4. A liquid ejecting apparatus comprising the liquid ejecting head according to claim 3.

5. The MEMS device according to claim 1, wherein the second substrate includes a third electrode layer which is electrically connected to the first electrode layer via a bump electrode, wherein the bump electrode includes a second resin having elasticity and a second conductive layer covering a surface of the second resin, and wherein the first resin and the second resin are disposed on the same substrate in any one substrate of the first substrate or the second substrate.

6. A liquid ejecting head which is the type of MEMS device according to claim 5, the head comprising:

a pressure chamber of which at least a portion is divided by the driving region; and a nozzle which communicates with the pressure chamber.

7. A liquid ejecting apparatus comprising the liquid ejecting head according to claim 6.

8. The MEMS device according to claim 1, wherein the second substrate includes a third electrode layer which is electrically connected to the first electrode layer via a bump electrode, wherein the bump electrode includes a second resin having elasticity and a second conductive layer covering a surface of the second resin, wherein the first resin is disposed on any one substrate of the first substrate or the second substrate, and wherein the second resin is disposed on the other substrate of the first substrate or the second substrate.

9. A liquid ejecting head which is the type of MEMS device according to claim 8, the head comprising:

a pressure chamber of which at least a portion is divided by the driving region; and a nozzle which communicates with the pressure chamber.

10. A liquid ejecting apparatus comprising the liquid ejecting head according to claim 9.

11. A liquid ejecting head which is the type of MEMS device according to claim 1, the head comprising:

a pressure chamber of which at least a portion is divided by the driving region; and a nozzle which communicates with the pressure chamber.

12. A liquid ejecting apparatus comprising the liquid ejecting head according to claim 11.

* * * * *